US009532421B2

(12) United States Patent
Wang et al.

(10) Patent No.: US 9,532,421 B2
(45) Date of Patent: Dec. 27, 2016

(54) LED DRIVING DEVICE AND CONTROL METHOD FOR LED DRIVING DEVICE

(71) Applicant: DELTA ELECTRONICS, INC., Taoyuan (CN)

(72) Inventors: Xiaobo Wang, Taoyuan (CN); Xinghua Zhang, Taoyuan (CN)

(73) Assignee: Delta Electronics, Inc., Taoyuan, Taiwan (CN)

( * ) Notice: Subject to any disclaimer, the term of this patent is extended or adjusted under 35 U.S.C. 154(b) by 0 days.

(21) Appl. No.: 15/013,080

(22) Filed: Feb. 2, 2016

(65) Prior Publication Data

US 2016/0242247 A1 Aug. 18, 2016

(30) Foreign Application Priority Data

Feb. 13, 2015 (CN) ..... 2015 1 0080392

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0809; H05B 33/0815; H05B 33/0818; H05B 33/0887
USPC ..... 315/122, 185 R, 193, 250, 254, 257, 276,315/291, 294, 297, 299, 301, 307, 308, 312, 313
See application file for complete search history.

(56) References Cited

U.S. PATENT DOCUMENTS 8,203,288 B2 * 6/2012 Lee ..... H05B 33/0818 315/209 R
2008/0224636 A1 * 9/2008 Melanson ..... H05B 33/0815 315/307
2011/0057576 A1 * 3/2011 Otake ..... H05B 33/0803 315/291
2014/0246979 A1 * 9/2014 Zhang ..... H05B 33/0815 315/122

* cited by examiner

*Primary Examiner* — Douglas W Owens
*Assistant Examiner* — Wei Chan
(74) *Attorney, Agent, or Firm* — Yunling Ren; Eaton & Van Winkle

(57) ABSTRACT

The present disclosure discloses a LED driving device and a control method for the same. The LED driving device includes a conversion unit, a dimming switch circuit and a control unit. The control unit includes a dimming control unit and a conversion control unit. The dimming control unit includes a comparison circuit, a constant-voltage dimming circuit and a constant-current dimming circuit. The comparison circuit compares a first signal that represents an output voltage output from the conversion unit with a reference signal, and outputs a first enabling signal and a second enabling signal. The constant-voltage dimming circuit receives the first enabling signal, and outputs a first driving signal to at least one second switch to perform constant-voltage dimming; and the constant-current dimming circuit receives the second enabling signal, and outputs a current-reference to the conversion control unit to perform constant-current dimming.

19 Claims, 9 Drawing Sheets

LED DRIVING DEVICE AND CONTROL METHOD FOR LED DRIVING DEVICE

This application is based upon and claims priority to Chinese Patent Application No. 201510080392.1, filed Feb. 13, 2015, the entire contents of which are incorporated herein by reference.

TECHNICAL FIELD

The present disclosure relates to a power supply, and more particularly, to a Light Emitting Diode (LED) driving device and a control method thereof.

BACKGROUND

There are generally two types of LED loads, i.e., voltage-type LED load and current-type LED load. A voltage-type LED load requires a constant-voltage output from a LED driver, while a current-type LED load requires a constant-current output from the LED driver. In order to meet the requirements of both types of LED loads, a standard power supply with a case (A can) is widely applied in the LED driver market in North America. For example, a 100 W class 2 output of LED power supply is generally rated at 24V/4.1 A. Such LED driver usually has an output of both constant-current and constant-voltage. That is, when the output voltage is smaller than 24V, the power supply works in a constant-current mode at 4.1 A; and when the output voltage reaches 24V, the power supply is maintained at a constant-voltage at 24V.

With increasing demands from energy consumption, it is desirable that a LED driver can have not only the above functions but also a dimming function. Since the current-type LED load and the voltage-type LED load usually require different dimming schemes and circuits, they generally require two specialized driving power supplies respectively. However, using two specialized driving power supplies in a LED driver results in an increased size and a complicated structure of the LED driver. This means an increased cost.

SUMMARY

In order to overcome the problems in the related art, the present disclosure provides a LED driving device and a control method thereof, which are capable of realizing dimming on both of a current-type LED load and a voltage-type LED load.

According to a first aspect of the present disclosure, there is provided a LED driving device. The LED driving device includes:

a conversion unit comprising at least one first switch to convert an Alternating Current (AC) or Direct Current (DC) input into a DC output that comprises an output current and an output voltage;

a dimming switch circuit electrically coupled to the conversion unit and a load, and comprising at least one second switch; and a control unit electrically coupled to the conversion unit and the dimming switch circuit and having a first input terminal to receive a first signal that represents the output voltage, a second input terminal to receive a second signal that represents the output current, a third input terminal to receive a dimming signal, a first output terminal to output a first driving signal to the at least one second switch, and a second output terminal to output a second driving signal to the at least one first switch;

wherein the control unit comprises:

a dimming control unit comprising:

a comparison circuit configured to compare the first signal with a reference signal, and output a first enabling signal and a second enabling signal;

a constant-voltage dimming circuit electrically coupled to the comparison circuit to receive the first enabling signal, and output the first driving signal according to the dimming signal and the first enabling signal; and a constant-current dimming circuit electrically coupled to the comparison circuit to receive the second enabling signal, and output a current-reference according to the dimming signal and the second enabling signal, and a conversion control unit electrically coupled to the constant-current dimming circuit to receive the current-reference, and output the second driving signal according to the current-reference and the second signal.

According to a second aspect of the present disclosure, there is provided a method for controlling a LED driving device.

The LED driving device includes a conversion unit comprising at least one first switch to convert an AC or DC input into a DC that comprises an output current and an output voltage; and a dimming switch circuit electrically coupled to the conversion unit and a load, and comprising at least one second switch.

The control method includes:

receiving a first signal that represents the output voltage, a second signal that represents the output current, and a dimming signal;

comparing the first signal with a reference signal, and outputting a first enabling signal and a second enabling signal;

outputting a first driving signal to the at least one second switch according to the dimming signal and the first enabling signal;

outputting a current-reference according to the dimming signal and the second enabling signal; and outputting a second driving signal to the at least one first switch according to the current-reference and the second signal.

In embodiments of the present disclosure, two dimming solutions for the current-type LED load and the voltage-type LED load are integrated in one LED driving device, and the type of the load is determined by detecting the output voltage of the load, so as to select a corresponding dimming manner to implement dimming. Thus, the structure of the LED driving device is simplified and the size of the LED driving device is reduced and thereby the costs are lowered.

DETAILED DESCRIPTION

Figure 1:
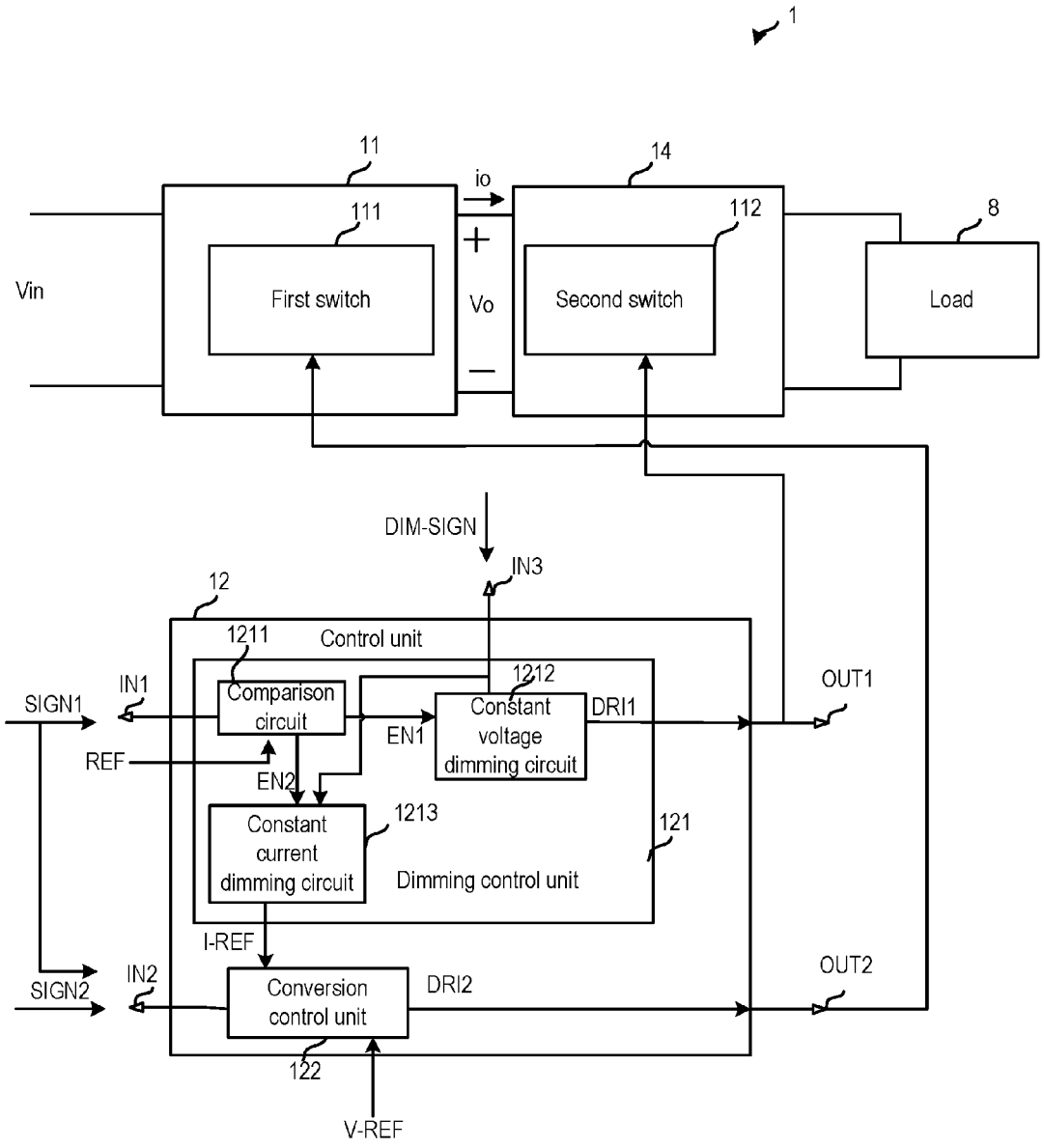
FIG. 1 illustrates a block diagram of a LED driving device according to an exemplary embodiment of the present disclosure.

FIG. 1 illustrates a block diagram of a LED driving device according to an exemplary embodiment of the present disclosure. The LED driving device 1 includes a conversion unit 11, a control unit 12 and a dimming switch circuit 14.

The conversion unit 11 receives an input Vin, which can be an alternating current (AC) or a direct current (DC) input, and outputs a DC output, i.e., a DC output voltage Vo and a DC output current io to a load 8. The conversion unit 11 includes at least one first switch 111.

The dimming switch circuit 14 is configured to control dimming, and includes at least one second switch 112.

The control unit 12 is electrically coupled to the conversion unit 11 and the dimming switch circuit 14. The control unit 12 has a first input terminal IN1, a second input terminal IN2, a third input terminal IN3, a first output terminal OUT1 and a second output terminal OUT2. The first input terminal IN1 is configured to receive a first signal SIGN1 that represents the output voltage Vo, the second input terminal IN2 is configured to receive a second signal SIGN2 that represents the output current io, the third input terminal IN3 is configured to receive a dimming signal DIM-SIGN, the first output terminal OUT1 is configured to output a first driving signal DRI1 to second switch 112 according to the first signal SIGN1 and the dimming signal DIM-SIGN, and the second input terminal OUT2 is configured to output a second driving signal DRI2 to the at least one first switch 111 according to the first signal SIGN1, the second signal SIGN2 and the dimming signal DIM-SIGN.

The control unit 12 includes a dimming control unit 121 and a conversion control unit 122. The dimming control unit 121 includes a comparison circuit 1211, a constant-voltage dimming circuit 1212 and a constant-current dimming circuit 1213.

The comparison circuit 1211 is configured to compare the first signal SIGN] with a reference signal REF, and output a first enabling signal EN1 and a second enabling signal EN2. The first enabling signal EN1 and the second enabling signal EN2 have logically opposite voltage.

The constant-voltage dimming circuit 1212 is electrically coupled to the comparison circuit 1211. The constant-voltage dimming circuit 1212 is configured to receive the first enabling signal EN1, and output the first driving signal DM to the at least one second switch 112 according to the dimming signal DIM-SIGN and the first enabling signal EN1.

The constant-current dimming circuit 1213 is electrically coupled to the comparison circuit 1211 to receive the second enabling signal EN2, and output a current-reference I-REF to the conversion control unit 122 according to the dimming signal DIM-SIGN and the second enabling signal EN2.

The conversion control unit 122 is configured to control the output voltage Vo or the output current io output from the conversion unit 11. The conversion control unit 122 compares the first signal SIGN1 with a voltage-reference V-REF or compares the second signal SIGN2 with the current-reference I-REF to output the second driving signal DRI2 to the at least one first switch 111. In one embodiment, the voltage-reference is set as a constant value, but it is not limited thereto. Since the conversion control unit 122 is a common circuit for those skilled in the art, it will not be elaborated in detail herein.

In the foregoing embodiment, the LED driving device 1 compares the first signal SIGN1 that represents the output voltage Vo with the reference signal REF, and selects, according to the comparison results, whether to enable the constant-voltage dimming circuit to perform constant-voltage dimming or enable the constant-current dimming circuit and the conversion control unit to perform constant-current dimming. Thus, the requirements of both of the constant-voltage dimming and the constant-current dimming can be satisfied by using one single driving device. The structure of the LED driving device can be simplified and the size of the LED driving device can be reduced, which therefore lowers the costs.

Figure 2:
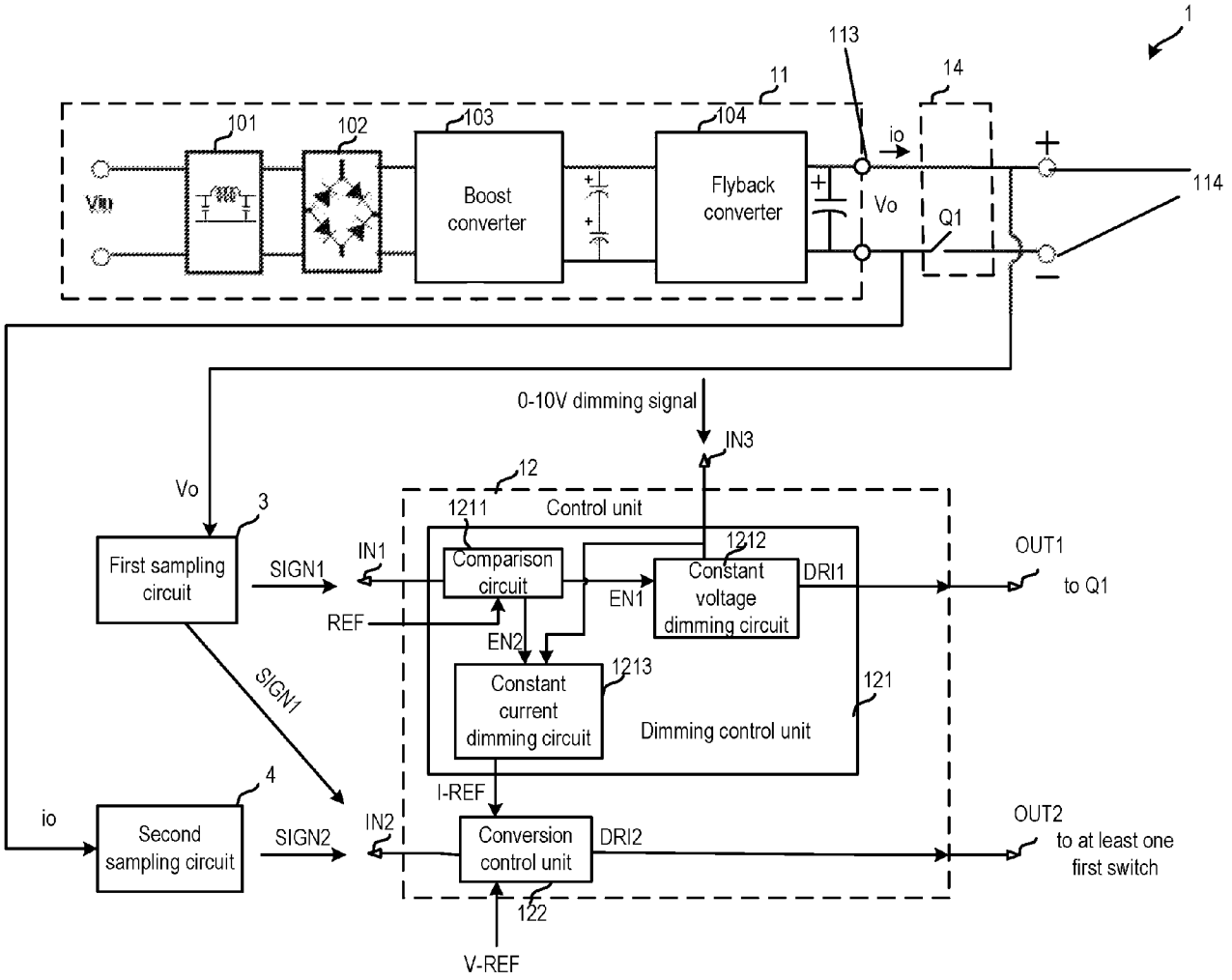
FIG. 2 illustrates a block diagram of a LED driving device according to an exemplary embodiment of the present disclosure.

FIG. 2 illustrates a block diagram of a LED driving device according to another exemplary embodiment of the present disclosure.

The conversion unit 11 includes an electromagnetism interference (EMI) filter 101, a rectifier bridge 102, a Boost converter 103, a flyback converter 104, a capacitor, and other components. The rectifier bridge 102, the Boost converter 103 and the flyback converter 104 make up a power conversion circuit of the conversion unit 11, and the power conversion circuit has at least one first switch (not shown). The second driving signal DRI2 of the control unit 12 is input to a control terminal of the at least one first switch, so as to control on and off of the first switch. In this way, the output power of the power conversion circuit can be controlled. Since the power conversion circuit is a common circuit for those skilled in the art, it will not be elaborated herein.

As shown in FIG. 2, the dimming switch circuit 14 is coupled to the conversion unit 11. The conversion unit 11 has a first output portion 113, and the dimming switch circuit 14 has a second output portion 114. The first output portion 113 is coupled to an output of the power conversion circuit to output the DC voltage Vo or the DC current io. The second output portion 114 is coupled to the load (e.g. the load 8 in FIG. 1). The load 8 can either be a voltage-type LED load or a current-type LED load. The dimming switch circuit 14 includes at least one second switch 112, such as a switch Q1 in FIG. 2. When Q1 is switched on, the second output portion 114 outputs the DC voltage Vo or the DC current io to the load. When Q1 is switched off, the second output portion 114 is disabled from outputting the DC voltage Vo or the DC current io. In the embodiment, the at least one second switch is exemplified as the switch Q1, but it is not limited thereto. Those skilled in the art may select different switch circuits to implement the above-mentioned functions according to practical applications.

Compared with FIG. 1, the control unit 12 in FIG. 2 further includes a first sampling circuit 3 and a second sampling circuit 4. The second sampling circuit 4 receives the output current io of the conversion unit 11, and outputs the second signal SIGN2 that represents the output current io. The second sampling circuit 4 can be implemented as a sampling resistor or a Hall device and the like, which is not limited thereto. The first sampling circuit 3 receives the output voltage Vo of the conversion unit 11, and outputs the first signal SIGN1 that represents the output voltage. The first sampling circuit 3 can be implemented as a voltage sensor or a Hall device and the like, which is not limited thereto.

As shown in FIG. 2, the dimming signal DIM-SIGN in the embodiment is a dimming signal of 0-10V, which is not limited thereto. The dimming signal can also be a pulse width modulation (PWM) dimming signal and the like. Those skilled in the art may select any dimming signal according to practical application. In the following description, the operating principle of the LED driving device will be described with reference to specific circuits in which 0-10V dimming signals or PWM dimming signals are applied, for example.

The control unit 12 receives the output current io, the output voltage Vo and the dimming signal DIM-SIGN, and after determining the type of the load, outputs the first driving signal DRI1 and second driving signal DRI2. Then the first driving signal DRI1 and the second driving signal DRI2 are input to a control terminal of the switch Q1 and a control terminal of the at least one first switch, respectively, so as to control the power output to the load 8. In this way, dimming in regard to different types of loads can be achieved.

When the load is a voltage-type LED load, the constant-voltage dimming circuit 1212 outputs the first driving signal DRI1 to the switch Q1 according to the dimming signal, for example, of 0-10V as shown in FIG. 2, so as to control a switching-on time and a switching-off time of the switch Q1. Meanwhile, the current-reference I-REF output from the constant-current dimming circuit 1213 and the voltage-reference V-REF are set as constant values. Therefore, the output voltage Vo and the output current io are controlled at the constant values, e.g. 24V and 4.1 A, by the conversion control unit 122. In this way, the power output from the first output portion 113 to the second output portion 114 varies with the change of the switching-on time of the switch Q1, causing a different power output to the load 8, thereby achieving the objective of dimming.

When the load is a current-type LED load, the first driving signal DRI output by the constant-voltage dimming circuit 1212 is set at a logic high level, so as to control the switch Q1 in a switching-on state. The first output portion 113 and the second output portion 114 are maintained coupled with each other. Meanwhile, the voltage-reference V-REF are set as a constant value, and the current-reference I-REF output from the constant-current dimming circuit 1213 varies with the change of the dimming signal. Therefore, the second driving signal DRI2 output to the at least one first switch varies with the change of the dimming signal. In this way, the power output to the second output portion 114 varies with the change of the dimming signal, which therefore achieves the objective of dimming.

In the embodiment, a method for determining the type of the load is implemented by a comparison circuit 1211. The comparison circuit 1211 compares the first signal SIGN1 with a reference signal REF. When the first signal SIGN1 is greater than the reference signal REF, the load is determined as a voltage-type LED load; and when the first signal SIGN1 is smaller than or equal to the reference signal REF, the load is determined as a current-type LED load. Take a 100 W class 2 output of LED power supply as an example. This LED power supply generally has a rated output of 24V/4.1 A. In view of other factors, a reference signal REF, can be set varying within 10% of the rated voltage (24V), for example, 22.6~26.4. Because the first signal SIGN1 is the sampled value of the output voltage Vo, if a sampling coefficient is kv, then the reference signal REF is kv times of the comparison reference. For example, the reference signal REF can be set at 22.6*kv~26.4*kv.

Figure 3:
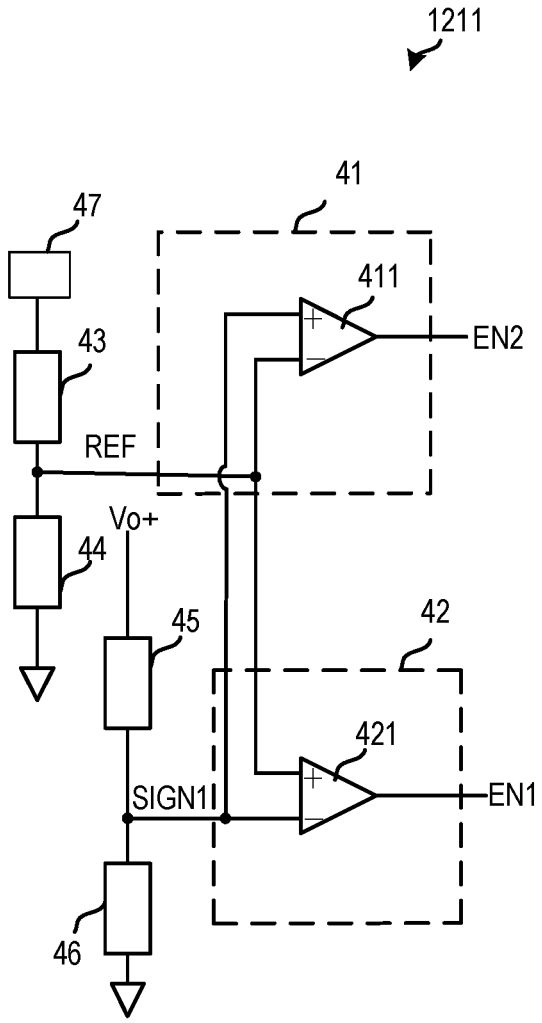
FIG. 3 illustrates a circuit diagram of a comparison circuit according to an exemplary embodiment of the present disclosure.

FIG. 3 illustrates a circuit diagram of a comparison circuit, according to an exemplary embodiment of the present disclosure. In the embodiment, the comparison circuit 1211 includes a first comparison circuit 41 and a second comparison circuit 42.

The first comparison circuit 41 receives the first signal SIGN1 and the reference signal REF, and outputs the second enabling signal EN2. The reference signal REF can be obtained by dividing a predetermined voltage 47 using two resistors 43 and 44. The first signal SIGN1 can be obtained by dividing the output voltage To of the conversion unit using two resistors 45 and 46. When the first signal SIGN1 is greater than the reference signal REF, the first comparison circuit 41 outputs the second enabling signal EN2 at a logic high level. When the first signal SIGN1 is smaller than or equal to the reference signal REF, the first comparison circuit 41 outputs the second enabling signal EN2 at a logic low level.

The second comparison circuit 42 receives the first signal SIGN1 and the reference signal REF, then outputs the first enabling signal EN1. When the first signal SIGN1 is greater than the reference signal REF, the second comparison circuit 42 outputs the first enabling signal EN1 at a logic low level, and when the first signal is smaller than or equal to the reference signal, the second comparison circuit 42 outputs the first enabling signal EN1 at a logic high level.

In the embodiment, the comparison circuit 1211 is implemented as two comparators 411 and 421, which is not limited thereto. In practical application, the comparison circuit 1211 can be implemented as one comparator, and can also be implemented in form of a digital chip or software.

Figure 4:
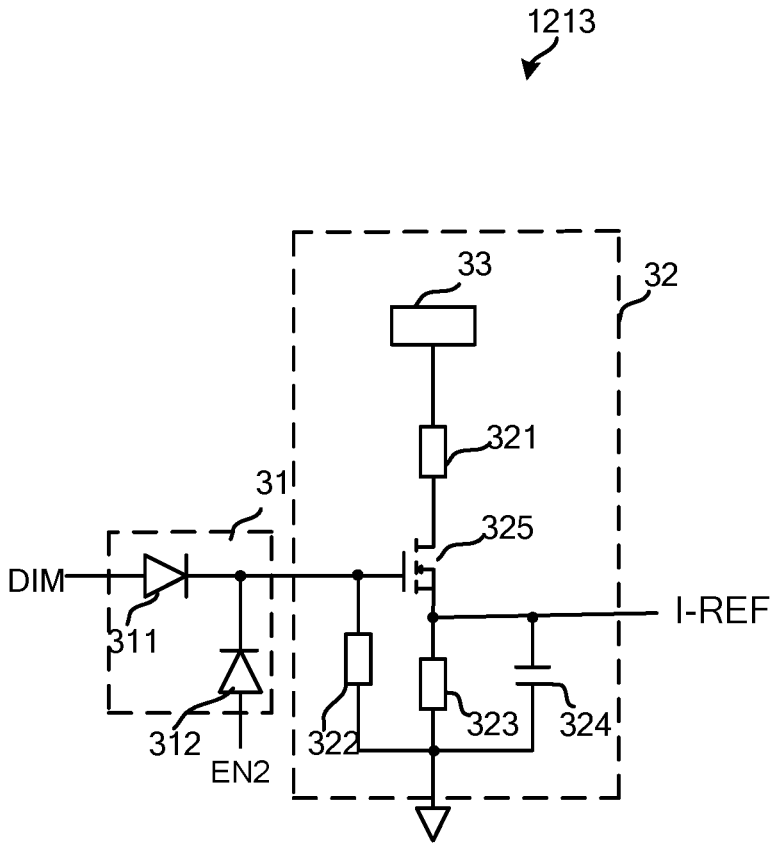
FIG. 4 illustrates a circuit diagram of a constant-current dimming circuit according to an exemplary embodiment of the present disclosure.

FIG. 4 illustrates a circuit diagram of a constant-current dimming circuit according to an exemplary embodiment of the present disclosure. The constant-current dimming circuit 1213 includes a first OR gate circuit 31 and a reference-current regulating circuit 32.

The first OR gate circuits 31 receives the dimming driving signal DIM and the second enabling signal EN2, and performs an OR logic operation on the dimming driving signal DIM and the second enabling signal EN2. In the embodiment, the first OR gate circuit 31 is implemented as two diodes (311, 312), which is not limited thereto. The first OR gate circuit 31 can also be implemented in other manners, for example, in form of an application-specific digital electronic device.

The reference-current regulating circuit 32 is electrically coupled to the first OR gate circuit 31 to generate the current-reference I-REF according to an output of the first OR gate circuit 31.

The reference-current regulating circuit 32 includes a first voltage source 33, a third switch 325, a pull-up resistor 321, a ground resistor 323 and a ground capacitor 324. The third switch 325 has a first terminal, a second terminal and a third terminal. The first terminal of the third switch 325 is coupled to a first voltage source 33 via the resistor 321, and the second terminal of the third switch 325 is coupled to a reference ground via the ground resistor 323 and the ground capacitor 324. The second terminal of the third switch 325 outputs the current-reference I-REF, and the control terminal of the third switch 325 receives an output of the first OR gate circuit 31. The ground resistor 323 and the ground capacitor 324 are connected in parallel. In some embodiments, the reference regulating circuit 32 further includes a resistor 322 connected between the control terminal of the switch 325 and the reference ground.

When the comparison circuit determines that the load is a voltage-type LED load and the second enabling signal EN2 is at logic high level, the output of the first OR gate circuit 31 is maintained at a logic high level, the switch 325 is maintained switched on, and the current-reference I-REF is a constant value. When the comparison circuit determines that the load is a current-type LED load and the second enabling signal EN2 is at logic low level, the output of the first OR gate circuit 31 is maintained at a logic level identical to the dimming driving signal DIM, the switch 325 is switched on and off according to the dimming driving signal DIM, and the current-reference I-REF varies with the change of the dimming signal.

Figure 5:
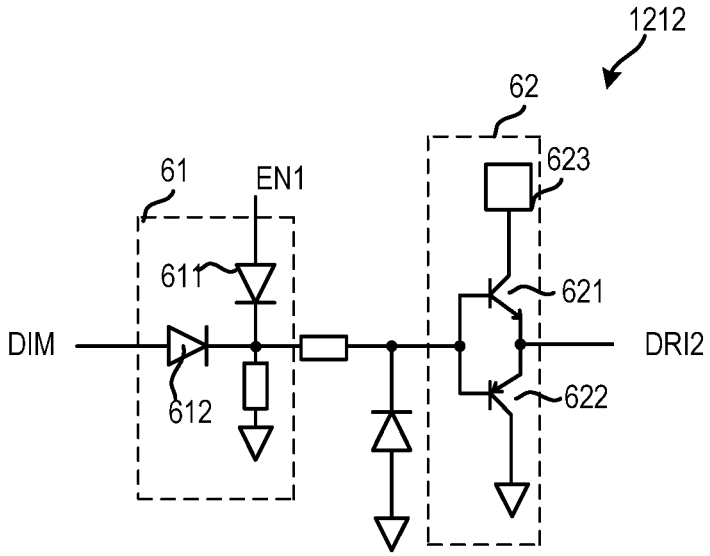
FIG. 5 illustrates a circuit diagram of a constant-voltage dimming circuit according to an exemplary embodiment of the present disclosure.

FIG. 5 illustrates a circuit diagram of a constant-voltage dimming circuit according to an exemplary embodiment of the present disclosure. The constant-voltage dimming circuit 1212 includes a second OR gate circuit 61 and an amplifying circuit 62.

The second OR gate circuit 61 receives the dimming driving signal DIM and the first enabling signal EN1, and performs an OR logic operation on the dimming driving signal DIM and the first enabling signal EN1. In the embodiment, the second OR gate circuit 61 is implemented as two diodes 611 and 612, which is not limited thereto. The second OR gate circuit 61 can also be implemented in other manners, for example, in a form of an application-specific digital electronic device.

The amplifying circuit 62 is electrically coupled to the second OR gate circuit 61, to receive and amplify an output of the second OR gate circuit 61, and output the first driving signal to a control terminal of the at least one second switch (for example, the switch Q1 in FIG. 2). In the embodiment, the amplifying circuit 62 is implemented as a totem pole structure formed by two triodes, which is not limited thereto. The amplifying circuit 62 can also be implemented in other manners, for example, in a form of an application-specific digital electronic device.

When the comparison circuit determines that the load is a voltage-type LED load and the first enabling signal EN1 is at logic low level, the output of the second OR gate circuit 61 is maintained at a logic level identical to the dimming driving signal DIM, and the switch Q1 is switched on and off according to the dimming driving signal DIM. When the comparison circuit determines that the load is a current-type LED load and the first enabling signal EN1 is at logic high level, the output of the second OR gate 62 is maintained at a logic high level, and the switch Q1 is maintained switched on.

In the embodiment of the present disclosure, the LED driving device can further include a dimming-driving-signal generating circuit. The dimming-driving-signal generating circuit is configured to receive the dimming signal DIM-SIGN, and generate a dimming driving signal DIM according to the dimming signal DIM-SIGN. Both the constant-voltage dimming circuit 1212 and the constant-current dimming circuit 1213 receive the dimming driving signal DIM, thus having dimming functions.

Figure 6:
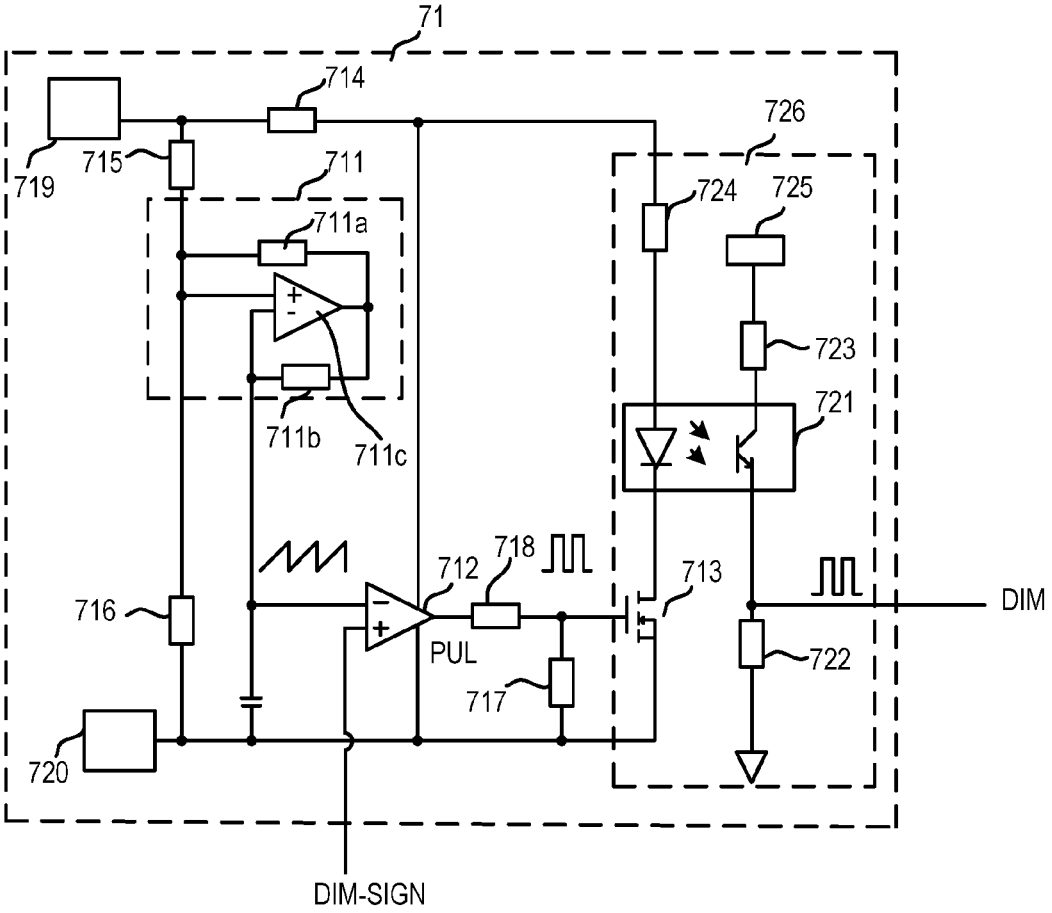
FIG. 6 illustrates a circuit diagram of a dimming-driving-signal generating circuit according to an exemplary embodiment of the present disclosure.

FIG. 6 illustrates a circuit diagram of a dimming-driving-signal generating circuit according to an exemplary embodiment of the present disclosure. The dimming-driving-signal generating circuit 71 includes: a sawtooth-wave-signal generating circuit 711, a second operational amplifier 712 and a fourth switch 713.

The sawtooth-wave-signal generating circuit 711 is configured to generate a sawtooth-wave signal based on a voltage. The sawtooth-wave-signal generating circuit 711 can be implemented as resistors 711*a* and 711*b* and a first operational amplifier 711*c*.

The second operational amplifier 712 is electrically coupled to the sawtooth-wave-signal generating circuit 711. The second operational amplifier 712 receives the dimming signal DIM-SIGN, for example, of 0-10V at its one input terminal, and is input with the sawtooth-wave signal at its another input terminal. The second operational amplifier 712 compares the dimming signal DIM-SIGN with the sawtooth-wave signal, then outputs a pulse signal PUL.

A signal transmission module 726 is coupled to the second operational amplifier 712. The signal transmission module 726 includes the fourth switch 713, which is connected via its control terminal to an output terminal of the second operational amplifier 712 for generating the dimming driving signal based on the pulse signal.

According to one embodiment, the signal transmission module 726 can further include an isolation circuit 721 (for example, an optic coupler). The isolation circuit 721 is coupled to the second terminal of the fourth switch 713, to generate the isolated dimming driving signal DIM.

In the embodiment as shown in FIG. 6, the first operational amplifier 711*c* is used to generate a sawtooth wave with a frequency of several hundreds of hz, which is then input to the negative input terminal of the second operational amplifier 712. The dimming signal DIM-SIGN of 0-10V is input to the positive input terminal of the second operational amplifier 712, then is compared to the sawtooth wave, so as to generate the pulse signal PUL at the output terminal of the second operational amplifier 712. The duty cycle of the pulse signal PUL is determined by the 0-10V dimming signal. For example, 10V corresponds to a maximum duty cycle of 100%, 5V corresponds to a duty cycle of 50%, and 0-1V corresponds to a minimum duty cycle of 10%, and so on.

In the embodiment as shown in FIG. 6, resistors 714, 715, 716, 717, 718, 722, 723, and 724 as well as voltage sources 719, 720 and 725, and other components can be included. Those skilled in the art can also add other electronic components according to practical applications, which will not be limited thereto.

Figure 7:
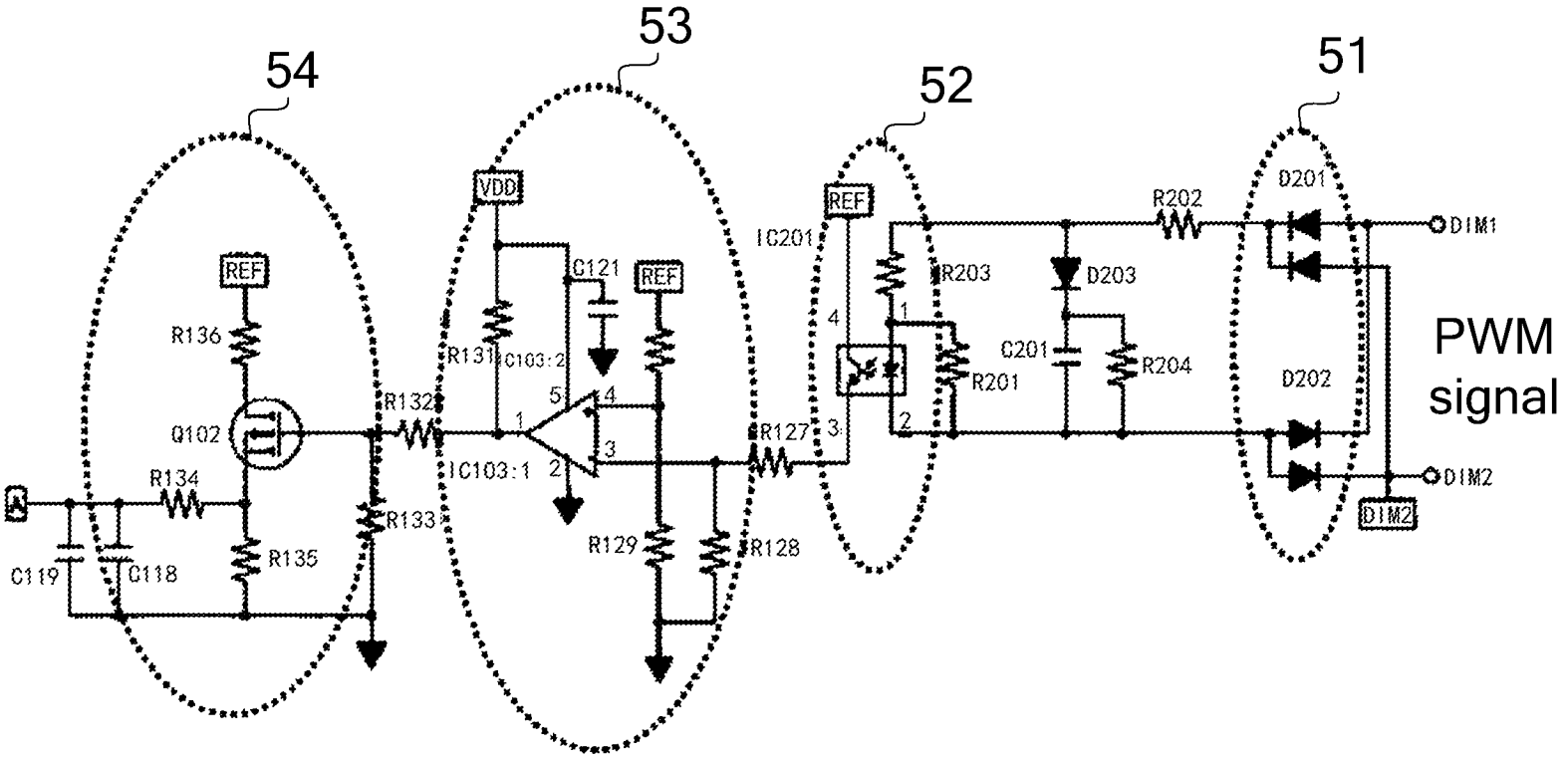
FIG. 7 illustrates a circuit diagram of a dimming-driving-signal generating circuit according to an exemplary embodiment of the present disclosure.

In other embodiment, the dimming signal can also be other types of signals, such as a PWM dimming signal. FIG. 7 illustrates a circuit diagram of a dimming-driving-signal generating circuit according to another exemplary embodiment of the present disclosure. The dimming-driving-signal generating circuit 5 can be applicable to the situation that a PWM dimming signal DIM-SIGN needs to be converted into a dimming driving signal DIM, which is not limited thereto.

The dimming-driving-signal generating circuit 5 can include a rectifier module 51, an isolation module 52, an inverting module 53 and a switch module 54.

The rectifier module 51 is configured to input a PWM signal and rectify the input PWM signal to output a rectified PWM signal.

The isolation module 52 is connected to the rectifier module 51 to generate an isolated PWM signal according to the rectified PWM signal.

The inverting module 53 is connected to the isolation module 52 to invert an isolated PWM signal received from the isolation module 52, so as to obtain an inverting PWM signal.

The switch module 54 is connected to the inverting module 53 to output the dimming driving signal DIM based on the inverting PWM signal.

Figure 8:
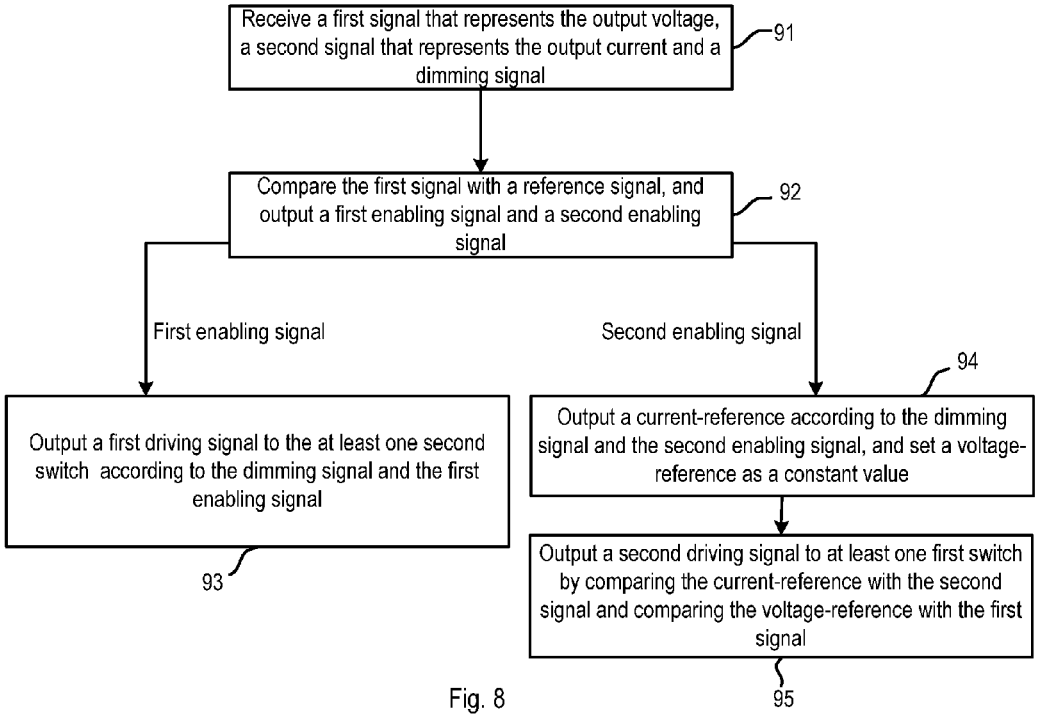
FIG. 8 illustrates a flow chart of a method for controlling a LED driving device according to an exemplary embodiment of the present disclosure.

The present disclosure also provides a method for controlling a LED driving device as shown in FIG. 8. The LED driving device is as shown in the embodiments in FIGS. 1 to 7, which will not be elaborated here.

The control method includes the following steps.

In step 91, a first signal SIGN1 that represents the output voltage Vo, a second signal SIGN2 that that represents the output current io, and a dimming signal DIM-SIGN are received.

In step 92, the first signal SIGN1 is compared with a reference signal REF, and a first enabling signal EN1 and a second enabling signal EN2 are output.

In step 93, a first driving signal DRI1 is output to the at least one second switch (for example, the switch Q1 in FIG. 2) according to the dimming signal DIM-SIGN and the first enabling signal EN1.

In step 94, a current-reference I-REF is output according to the dimming signal and the second enabling signal, and a voltage-reference V-REF is set as a constant value.

In step 95, a second driving signal DRI2 is output to the at least one first switch by comparing the current-reference I-REF with the second signal SIGN2 and comparing the voltage-reference V-REF with the first signal SIGN1.

According to one embodiment, the conversion unit 11 can have a first output portion 113, and the dimming switch circuit 14 has a second output portion 114 (for example, see FIG. 2). The second output portion 114 is coupled to the load 8 and outputs the DC voltage Vo or DC current io when the at least one second switch is switched on, and is disabled from outputting the DC voltage Vo or DC current io when the at least one second switch Q1 is switched off.

Figure 9:
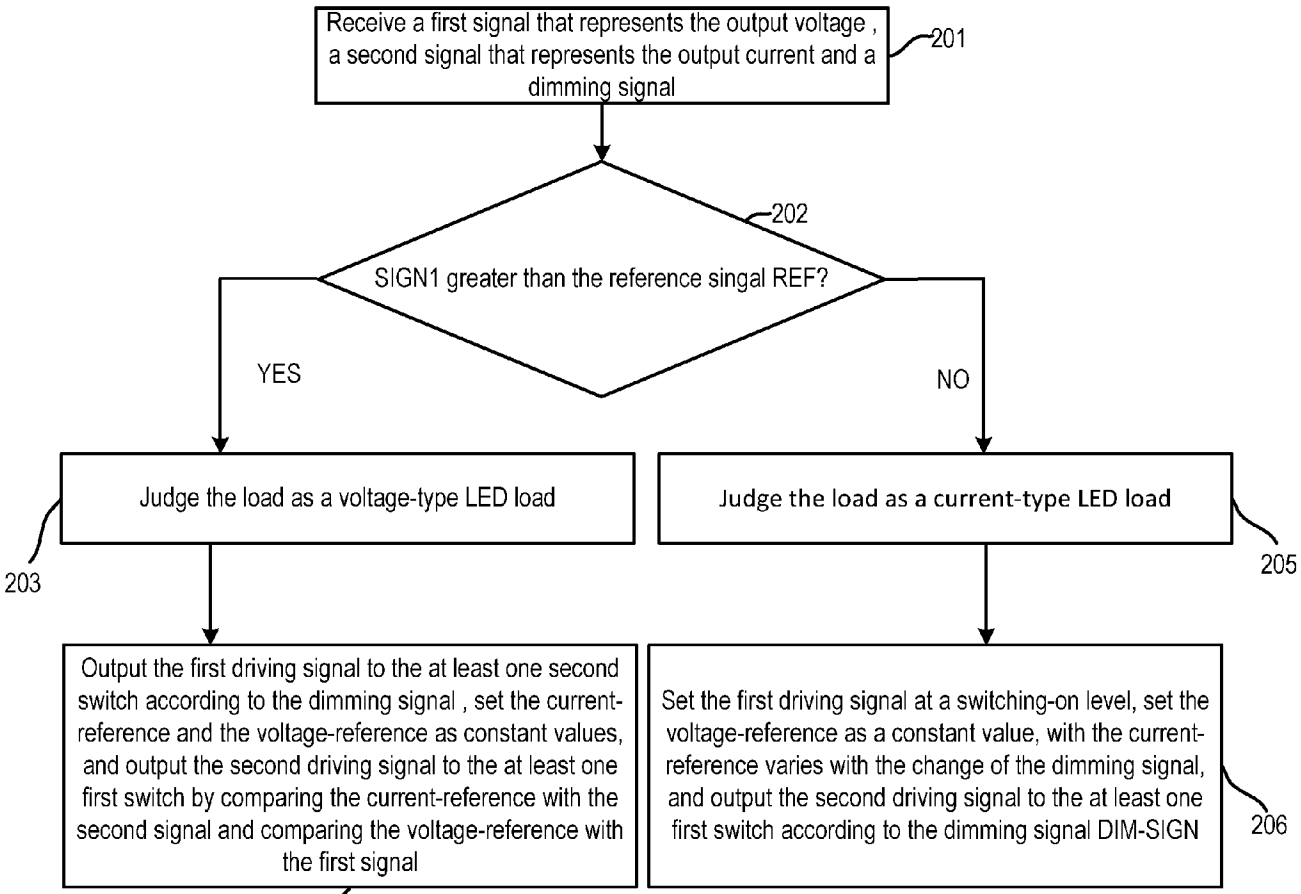
FIG. 9 illustrates a flow chart of another method for controlling a LED driving device according to an exemplary embodiment of the present disclosure.

According to an embodiment, as shown in FIG. 9, a first signal SIGN1 that represents the output voltage Vo, a second signal SIGN2 that that represents the output current io, and a dimming signal DIM-SIGN are received (step 201). When the first signal SIGN1 is greater than the reference signal REF (step 202), the load is determined as a voltage-type LED load (step 203), the first driving signal DRI1 is output to the at least one second switch according to the dimming signal DIM-SIGN, and the current-reference I-REF and the voltage-reference V-REF are set as constant values, the second driving signal DRI2 is output to the at least one first switch by comparing the current-reference I-REF with the second signal SIGN2 and comparing the voltage-reference V-REF with the first signal SIGN1 (step 204).

When the first signal SIGN1 is smaller than or equal to the reference signal REF, the load is determined as a current-type LED load (step 205), the first driving signal DM is set at a switching-on level to control the at least one second switch in a switching-on state, the voltage-reference V-REF is set as a constant value, the current-reference varies with the change of the dimming signal, and the second driving signal DRI2 is output to the at least one first switch according to the dimming signal DIM-SIGN (step 206).

According to one embodiment, the control method can further include the step of generating a dimming driving signal DIM according to the dimming signal.

According to one embodiment, the method can further include:

performing an OR logic operation (for example, by the first OR gate circuit 31 in FIG. 4) on the dimming driving signal DIM and the second enabling signal EN2; and generating the current-reference I-REF according to a result of the OR logic operation of the dimming driving signal DIM and the second enabling signal EN2.

According to one embodiment, the method can further include:

performing an OR logic operation (for example, by the second OR gate circuit 61 in FIG. 5) on the dimming driving signal DIM and the first enabling signal EN1; and generating the first driving signal DM according to a result of the OR logic operation of the dimming driving signal DIM and the first enabling signal EN1.

According to one embodiment, the generating of the dimming driving signal DIM according to the dimming signal includes:

generating a sawtooth-wave signal based on a voltage, for example, using an operational amplifier; and generating the dimming driving signal DIM based on the dimming signal and the sawtooth-wave signal.

According to one embodiment, the dimming signal can be a PWM signal. The generating of the dimming driving signal according to the dimming signal can include (see the embodiment described in FIG. 6):

receiving and rectifying a PWM signal and generating a rectified PWM signal;

isolating a rectified PWM signal to generate an isolated PWM signal;

inverting a rectified PWM signal to obtain in inverting PWM signal; and outputting the dimming driving signal based on the inverting PWM signal.

With respect to the details of the method for controlling the LED driving device in the present disclosure, please refer to the foregoing description about the LED driving device, which will thus not be elaborated herein.

Although the present disclosure has been described with reference to specific embodiments, it should be understood that the terminologies herein are for illustration purposes rather than to limit the present invention. The present disclosure can be implemented in many specific embodiments without departing from the spirit and scope of the present disclosure, and thus it shall be appreciated that the above embodiments shall not be limited to any details described above, but shall be interpreted broadly within the spirit and scope defined by the appended claims. The appended claims intend to cover all the modifications and changes falling within the scope of the appended claims and equivalents thereof.

What is claimed is:

1. A LED driving device, comprising:

a conversion unit comprising at least one first switch to convert an Alternating Current (AC) or Direct Current (DC) input into a DC output that comprises an output current and an output voltage;

a dimming switch circuit electrically coupled to the conversion unit and a load, and comprising at least one second switch; and a control unit electrically coupled to the conversion unit and the dimming switch circuit and having a first input terminal to receive a first signal that represents the output voltage, a second input terminal to receive a second signal that represents the output current, a third input terminal to receive a dimming signal, a first output terminal to output a first driving signal to the at least one second switch, and a second output terminal to output a second driving signal to the at least one first switch;

wherein the control unit comprises:

a dimming control unit comprising:

a comparison circuit configured to compare the first signal with a reference signal, and output a first enabling signal and a second enabling signal;

a constant-voltage dimming circuit electrically coupled to the comparison circuit to receive the first enabling signal, and output the first driving signal according to the dimming signal and the first enabling signal; and a constant-current dimming circuit electrically coupled to the comparison circuit to receive the second enabling signal, and output a current-reference according to the dimming signal and the second enabling signal, and a conversion control unit electrically coupled to the constant-current dimming circuit to receive the current-reference, and output the second driving signal according to the current-reference and the second signal.

2. The LED driving device according to claim 1, wherein the conversion unit has a first output portion, and the dimming switch circuit has a second output portion coupled to the load, wherein the dimming switch circuit is controlled to enable or disable outputting the output current and the output voltage according to the switch state of the at least one second switch.

3. The LED driving device according to claim 1, wherein:

when the first signal is greater than the reference signal, the constant-voltage dimming circuit outputs the first driving signal to the at least one second switch according to the dimming signal and the first enabling signal to control switching on time and switching off time of the at least one second switch to implement dimming, and the constant-current dimming circuit outputs the current-reference which is at a preset current value; and when the first signal is smaller than or equal to the reference signal, the constant-voltage dimming circuit outputs the first driving signal which is set at a switching-on level to control the at least one second switch in an on-state, and the constant-current dimming circuit outputs the current-reference to the conversion control unit according to the dimming signal and the second enabling signal.

4. The LED driving device according to claim 1, wherein the dimming control unit further comprises a dimming-driving-signal generating circuit configured to receive the dimming signal and generate and output a dimming driving signal according to the dimming signal to the constant-voltage dimming circuit and the constant-current dimming circuit.

5. The LED driving device according to claim 4, wherein the constant-current dimming circuit comprises:

a first OR gate circuit configured to receive the dimming driving signal and the second enabling signal, and perform an OR logic operation on the dimming driving signal and the second enabling signal; and a reference-current regulating circuit coupled to the first OR gate circuit to generate the current-reference according to an output of the first OR gate circuit.

6. The LED driving device according to claim 5, wherein the reference-current regulating circuit comprises a third switch having a first terminal coupled to a voltage source via a first resistor, a second terminal coupled to a reference ground to output the current-reference, and a control terminal to receive the output of the first OR gate circuit.

7. The LED driving device according to claim 4, wherein the constant-voltage dimming circuit comprises:

a second OR gate circuit configured to receive the dimming driving signal and the first enabling signal, and perform an OR logic operation on the dimming driving signal and the first enabling signal; and an amplifying circuit coupled to the second OR gate circuit to receive and amplify an output of the second OR gate circuit, and output the first driving signal to a control terminal of the at least one second switch.

8. The LED driving device according to claim 4, wherein the dimming-driving-signal generating circuit comprises:

a sawtooth-wave-signal generating circuit configured to generate a sawtooth-wave signal based on a voltage;

a second operational amplifier coupled to the sawtooth-wave-signal generating circuit, and having an input terminal to receive the dimming signal and another input terminal to receive the sawtooth-wave signal; and a signal transmission module comprising a fourth switch which has a control terminal connected to an output terminal of the second operational amplifier, and a second output terminal to generate the dimming driving signal based on an output of the second operational amplifier.

9. The LED driving device according to claim 4, wherein the dimming signal is a pulse width modulation signal, and the dimming-driving-signal generating circuit comprises:

a rectifier module configured to receive and rectify the pulse width modulation signal to output a rectified signal;

an isolation module connected to the rectifier module to generate an isolated signal according to the rectified signal;

an inverting module connected to the isolation module to receive the isolated signal and invert it to generate an inverting signal; and a switch module connected to the inverting module to output the dimming driving signal based on the inverting signal.

10. The LED driving device according to claim 8, wherein the signal transmission module further comprises an isolation circuit coupled to the second output terminal of the fourth switch to generate an isolated dimming driving signal.

11. The LED driving device according to claim 1, wherein the comparison circuit comprises:

a first comparison circuit configured to receive the first signal and the reference signal, and output the second enabling signal of a high level when the first signal is greater than the reference signal, and output the second enabling signal of a low level when the first signal is smaller than or equal to the reference signal; and a second comparison circuit configured to receive the first signal and the reference signal, output the first enabling signal of a low level when the first signal is greater than the reference signal, and output the first enabling signal of a high level when the first signal is smaller than or equal to the reference signal.

12. A method for controlling a LED driving device, wherein the LED driving device comprises:

a conversion unit comprising at least one first switch to convert an Alternating Current (AC) or Direct Current (DC) input into a DC output that comprises an output current and an output voltage; and a dimming switch circuit electrically coupled to the conversion unit and a load, and comprising at least one second switch;

wherein the control method comprises:

receiving a first signal that represents the output voltage, a second signal that represents the output current, and a dimming signal;

comparing the first signal with a reference signal, and outputting a first enabling signal and a second enabling signal;

outputting a first driving signal to the at least one second switch according to the dimming signal and the first enabling signal;

outputting a current-reference according to the dimming signal and the second enabling signal; and outputting a second driving signal to the at least one first switch according to the current-reference and the second signal.

13. The method according to claim 12, wherein the conversion unit has a first output portion, and the dimming switch circuit has a second output portion coupled to the load, wherein the dimming switch circuit is controlled to enable or disable outputting the output current and the output voltage according to the switch state of the at least one second switch.

14. The method according to claim 12, wherein the outputting a first driving signal comprises:

when the first signal is greater than the reference signal, outputting the first driving signal to the at least one second switch according to the dimming signal and the first enabling signal to control switching on time and switch off time of the at least one second switch to implement dimming, and setting the current-reference as a preset current value; and when the first signal is smaller than or equal to the reference signal, setting the first driving signal at a switching-on level to control the at least one second switch in an on-state, and outputting the current-reference to the conversion control unit according to the dimming signal and the second enabling signal.

15. The method according to claim 12, further comprising:

generating a dimming driving signal according to the dimming signal.

16. The method according to claim 15, further comprising:

performing an OR logic operation on the dimming driving signal and the second enabling signal; and generating the current-reference according to a result of the OR logic operation.

17. The method according to claim 15, further comprising:

performing an OR logic operation on the dimming driving signal and the first enabling signal; and generating the first driving signal according to a result of the OR logic operation.

18. The method according to claim 12, wherein the generating of the dimming driving signal according to the dimming signal comprises:

generating a sawtooth-wave signal based on a voltage; and generating the dimming driving signal based on the dimming signal and the sawtooth-wave signal.

19. The method according to claim 12, wherein the dimming signal is a pulse width modulation signal; and the generating of the dimming driving signal according to the dimming signal comprises:

receiving and rectifying the pulse width modulation signal to generate a rectified signal;

isolating the rectified signal to generate an isolated signal;

inverting the isolated signal to generate an inverting signal; and outputting the dimming driving signal based on the inverting signal.

* * * * *